United States Patent [19]

Kotani et al.

[11] 4,220,508

[45] Sep. 2, 1980

[54] PROCESS FOR ELECTROLYTIC ETCHING

[75] Inventors: Yasutoyo Kotani; Kazuo Sawada; Shuzo Nagai; Takao Ogino; Seiji Watabe, all of Osaka, Japan

[73] Assignee: Sumitomo Electric Industries, Ltd., Osaka, Japan

[21] Appl. No.: 955,168

[22] Filed: Oct. 27, 1978

[30] Foreign Application Priority Data

Oct. 28, 1977 [JP] Japan ..... 52-130036

[51] Int. Cl.[2] ..... C25F 3/04; C25F 3/14; C25F 7/00

[52] U.S. Cl. ..... 204/129.65; 204/129.1; 204/297 W

[58] Field of Search ..... 204/129.65, 129.6, 129.5, 204/129.4, DIG. 7, 224 R, 297 W, 129.1

[56] References Cited

U.S. PATENT DOCUMENTS

| | | | |
|---|---|---|---|
| 2,190,440 | 2/1940 | Beebe | 204/297 W |
| 3,010,885 | 11/1961 | Schink | 204/129.65 |
| 3,017,341 | 1/1962 | Oelgoetz | 204/DIG. 7 |
| 3,438,880 | 4/1969 | Martin | 204/129.4 |
| 3,471,338 | 10/1969 | Trachtenberg | 204/129.65 |

*Primary Examiner*—T. M. Tufariello

*Attorney, Agent, or Firm*—Wenderoth, Lind & Ponack

[57] ABSTRACT

A process and apparatus for electrolytic etching of aluminum or its alloy is disclosed wherein an electric current is passed between an anode and a cathode which are spaced opposed in an electrolytic bath with a workpiece removably supported on an insulating frame so that the side of the workpiece to be etched faces the cathode, the insulating frame being disposed between the anode and the cathode and having at least one opening formed therein.

10 Claims, 18 Drawing Figures

PROCESS FOR ELECTROLYTIC ETCHING

The present invention relates to a process and apparatus for electrolytic etching, and more particularly to a process and apparatus for the surface treatment of aluminum or aluminum alloy material.

When coating such a material with a synthetic resin or paint it is normally required to pre-roughen the surface to be coated thereby assuring a tough bond between the substrate and the coating material.

The various pre-roughening methods include mechanical ones such as sandblasting, chemical ones using acids or alkalis, and electrochemical ones. However, mechanical methods cannot provide sufficient roughening for a secure bond with the substrate. Also, chemical methods require a precise control of the concentration and temperature of the chemicals used to maintain a constant amount of roughening.

In contrast, the electrochemical method can provide a sufficiently roughened surface for secure bonding and makes it possible to easily obtain a uniformly roughened surface by controlling the current, voltage, and time variables.

The conventional process for electrochemical treatment of aluminum is to pass an electric current in an electrolyte between a cathode which is usually a metal plate and an anode which is itself the aluminum substrate to be treated. However, since a contact has to be provided on the aluminum substrate itself, not only does the treatment leave undesirable traces of contact but also poor contact often occurs. Further, the necessity of providing a contact on each plate to be treated makes difficult automatic and continuous treatment where a large number of workpieces in the form of plates, dishes, or the like have to be treated.

In some applications, only one side, not both, of the aluminum substrate needs to be surface treated. In such cases, conventional processes require that the opposite side not to be coated be completely covered with an insulating material so as to protect it from roughening. Also, the conventional process requires strict parallel alignment between the cathode plate and the workpiece so as to insure uniform roughening. Therefore, the surface to be treated must be completely parallel to the cathode plate. Poor alignment relative to the cathode plate during movement of the workpiece in the bath results in uneven roughening. These limitations pose various problems in the operation and construction of the system.

An object of this invention is to provide a process for electrolytic etching which still roughen only one side of aluminum material uniformly.

Another object of this invention is to provide a process for electrolytic etching which can treat a large number of aluminum plates continuously and efficiently.

A further object of this invention is to provide an apparatus for carrying out the above-described process.

According to this invention there is provided a process and apparatus for electrolytic etching wherein an electric current is passed between an anode and a cathode which are spaced opposed in an electrolytic bath with a workpiece removably supported on an insulating frame so that the side of the workpiece to be etched faces the cathode, said insulating frame being disposed between the anode and the cathode and having at least one opening formed therein.

Other objects and advantages will be apparent from the following description taken with reference to the accompanying drawings, in which.

In the drawings, like reference numerals designate like or corresponding parts throughout.

Figure 1:
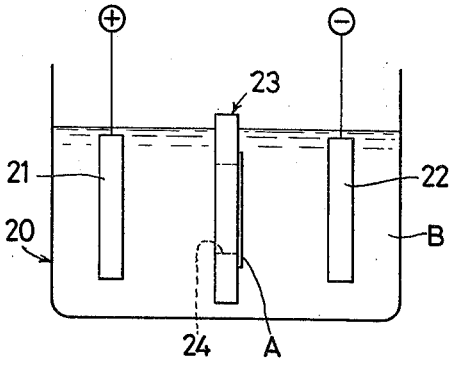
FIG. 1 is a diagrammatic view showing the basic arrangement according to this invention.
Figure 4:
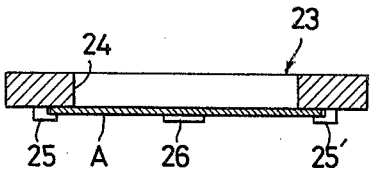
FIG. 4 is a sectional view taken along the lines 4—4 of FIG. 3.

Referring to FIG. 1, an anode plate 21 and a cathode plate 22 made of aluminum, stainless steel or other metal are located opposite each other in an electrolytic bath 20 filled with an electrolyte B which comprises an aqueous solution of a halide such as sodium chloride and ammonium chloride.

Figure 2:
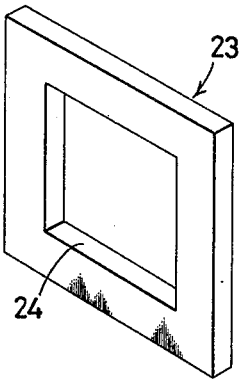
FIG. 2 is a perspective view of an insulating frame used therein.
Figure 3:
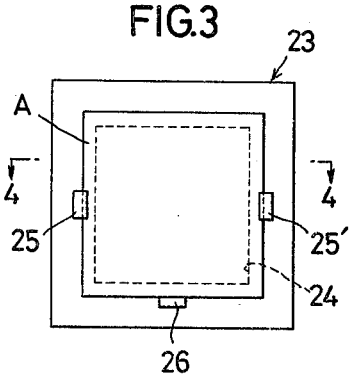
FIG. 3 is a front view thereof with the work mounted thereon.

Between the anode plate and the cathode plate is placed a frame 23 which is made of an insulating material such as bakelite and formed with an opening 24 (FIG. 2). A plate A to be treated, which is made of aluminum or one of its alloys is supported on the frame 23 on its side and facing the cathode plate 22. The manner of supporting the plate is not critical. For example, it may be supported by means of holders 25 and 25' with a projection 26 mounted on the frame 23 (FIG. 3).

When an electric current is passed between the plates 21 and 22, the plate A to be treated will be indirectly energized through the opening 24 in the frame in a manner so that only the side facing the cathode plate 22 is subject to etching. The insulating frame 23 serves both as a support for the plate A and as a block which is effective particularly when only one side of the plate has to be etched uniformly.

Without this insulating frame the peripheral region of the work would remain unetched because it would be difficult to charge such a region positively. In contrast, with the insulating frame the plate A will be charged uniformly so that its entire surface will be uniformly etched.

Figure 5:
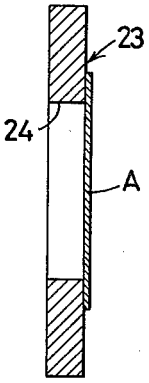
FIGS. 5 and 6 are sectional views showing how the work is mounted.
Figure 6:
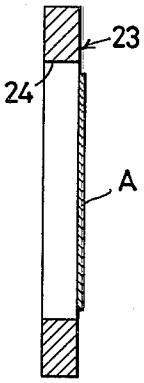

However, for uniform etching of a single side, the peripheral region of the work does not necessarily have to be completely physically blocked over its entire periphery. Although it is preferable to provide in the frame 23 an opening 24 for covering the peripheral portion of the plate A as in FIG. 5, the frame 23 will also function effectively as a screen because of the effect of the resistance of the electrolyte even if there is a gap between the plate A and the opening edge over part or the whole of the periphery of the plate as in FIG. 6. The gap is preferably less than 10 mm, although this depends on the resistance of the particular electrolyte used, the voltage used, the current density, the size of the plate to be treated, etc.

Figure 7:
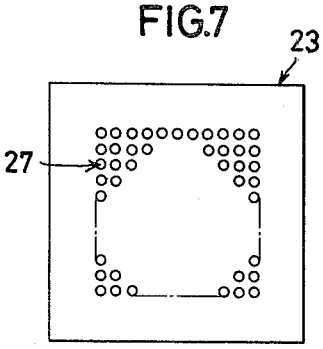
FIG. 7 is a front view of another example of the insulating frame.

The insulating frame 23 may have any desired outer periphery and may have a plurality of openings instead of one or a multiplicity of small holes 27 as illustrated in FIG. 7. These openings 24 or small holes 27 are preferably, but not exclusively, formed similar to the outline of the plate to be treated. Also, a plurality of workpieces to be treated, instead of a single one, may be supported on the frame 23.

The operating parameters are preferably within the following ranges: Voltage: 5–25 V, Current density between anode and cathode: 0.03–1.5 A/cm$^2$, time for treatment: 1–10 minutes, Concentration of electrolyte: 10–100 g/l, Temperature: 20°–60° C.

As described above, only one side of the plate will be efficiently roughened by indirect energization through an insulating frame having an opening or openings. Furthermore, this process eliminates the requirement of providing a contact on each workpiece to be treated and covering its one side with an insulator. Also, in moving the work in the bath, a strict parallelism relative to the cathode plate is no longer required. This facilitates the handling of the workpiece in and out of the bath and allows continuous treatment in the bath.

The following examples are illustrative of the process of this invention:

EXAMPLE 1

Two identical plates of aluminum having a purity of 99% and having a size of 300 mm×400 mm×2 mm were used for the anode and cathode plates. A 250 mm×250 mm×2 mm plate of the same material was mounted on a 330 mm×330 mm×10 mm frame made of bakelite and having a 210 mm×210 mm opening and located substantially parallel to the anode and cathode plates. The electrolyte used was an aqueous solution of sodium chloride having a concentration of 50 grams per liter. The plate was subjected to electrolytic etching in the electrolyte with a DC current being passed between the anode and the cathode under the following conditions: voltage; about 10 V, current density; 0.05 A/cm$^2$, treatment time; 400 seconds.

The aluminum plate thus obtained had one side uniformly roughened over its entire surface while the other side showed no change.

EXAMPLE 2

The same plate was treated between the same electrode plates under the same conditions as in Example 1 except that a bakelite frame of the same size but having a plurality of holes 50 mm in diameter in a 300 mm×300 mm area was used.

The aluminum plate thus obtained had only one side uniformly roughened over its entire surface as in Example 1.

EXAMPLE 3

The same plate as in Example 1 was treated by use of the same electrode plates and the same bakelite frame under the same conditions as in Example 1 except that the frame was inclined about 10 degrees relative to the anode and cathode plates.

The result was the same, that is, only one side of the plate was uniformly roughened over its entire surface.

EXAMPLE 4

A 99% aluminum disc 250 mm in diameter and 2 mm thick was pressed into a recess in a dish 10 mm deep. The dish was mounted on a 330 mm×330 mm×10 mm bakelite frame having a round opening 210 mm in diameter with the recess facing the cathode plate and the disc was treated under the same conditions as in Example 1.

As a result, only the recessed side was uniformly roughened over the entire surface.

EXAMPLE 5

By use of the same electrode plates and the same bakelite frame as in Example 1, a 207 mm×207 mm×2 mm aluminum plate of 99% aluminum was mounted on the frame with a gap of 3 mm left from the edge of the opening in the frame and was treated under the same conditions as in Example 1.

Examination of the aluminum plate thus treated showed that only one side had been roughened uniformly.

Next, several processes and apparatus more suitable for industrial application of the above described concept will be described hereinbelow.

Figure 8:
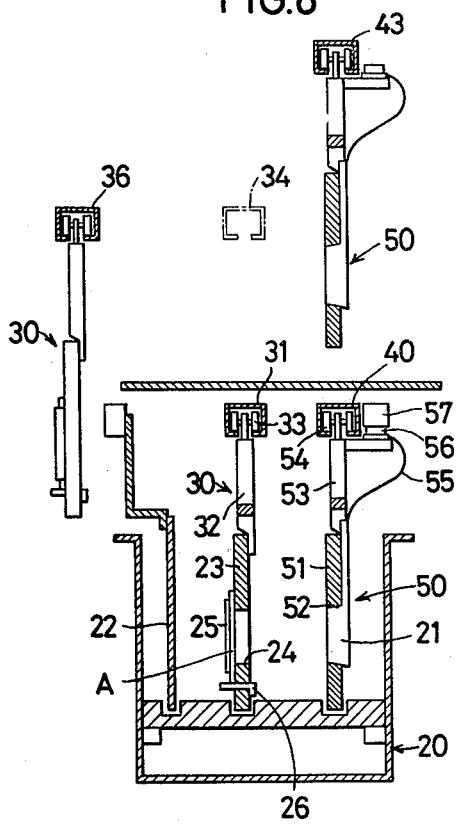
FIG. 8 is a vertical sectional view of a first embodiment of this invention.
Figure 11:
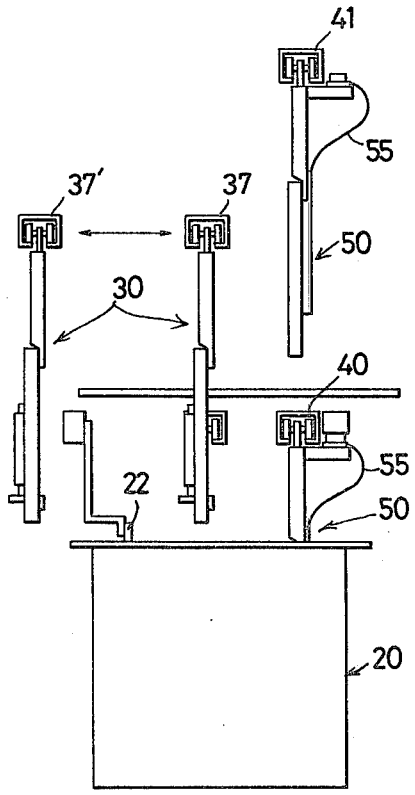
FIG. 11 is a side view thereof
Figure 9:
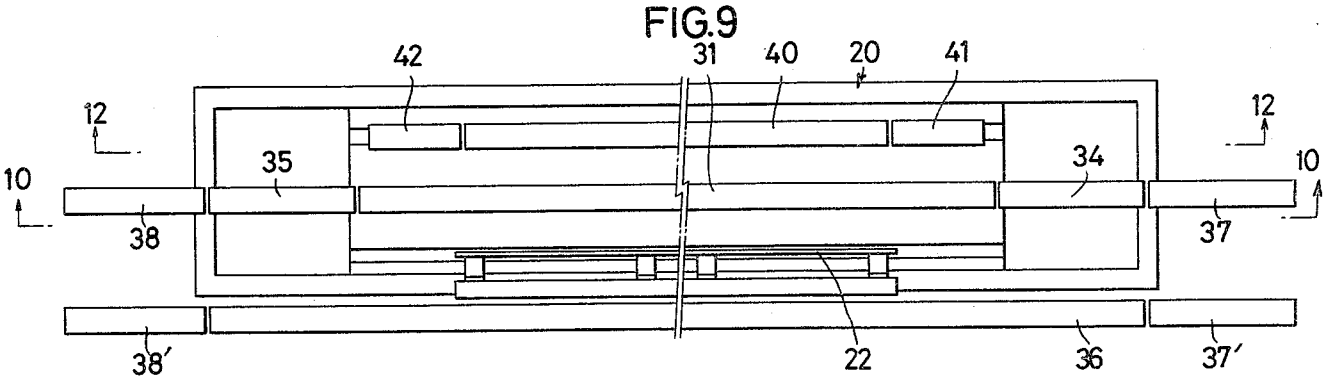
FIG. 9 is a plan view thereof.
Figure 10:
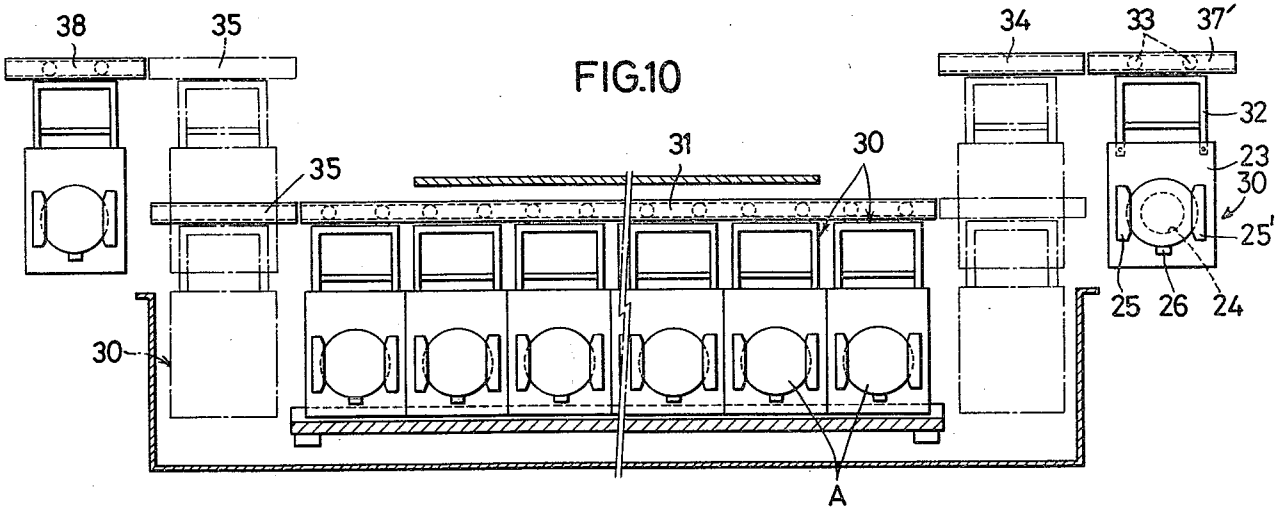
FIG. 10 is a sectional view taken along the lines 10—10 of FIG. 9.
Figure 12:
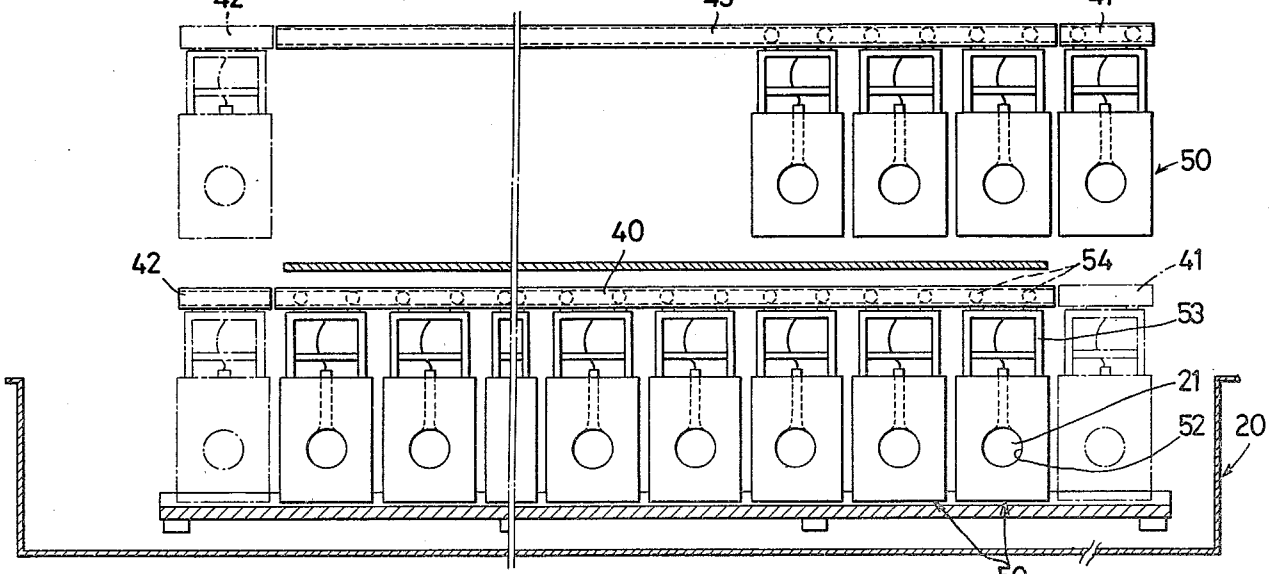
FIG. 12 is a sectional view taken along the lines 12—12 of FIG. 9.

Referring to FIGS. 8–10, in an electrolytic bath 20 of a suitable length are positioned an anode plate 21 and a space opposed cathode plate 22 between and over which is provided a guide rail 31. A plurality of casettes 30 are movably suspended from the guide rail, each casette carrying a plate A to be treated (FIG. 10).

Each casette 30 comprises a frame 32 and an insulating frame 23. The former is provided at its top with a pair of rollers 33 adapted to run along the guide rail 331. The insulating frame 23 has therein an opening 24 for energization. The plate A is supported on the insulating frame 23 by means of supports 25 and 25' and stop 26. The stop 26 is adapted to retract away from the frame and workpiece for allowing the treated plate A to drop off the insulating frame 23.

The workpiece A to be treated may be in the form of a disc, a rectangular plate, a dish, or any other desired configuration. A casette may be adapted to carry any number of workpieces. Accordingly, the insulating frame 23 also may be of any shape or structure.

As illustrated in FIGS. 9 and 10, at each end of a guide rail 31 is elevatably mounted a guide member 34 (35) which can carry a casette 30. These guide members are used to supply a casette holding a new plate A to the guide rail 31 and to take a casette having a treated plate out of the electrolytic bath. Thus, these guide members are vertically movable between a lower position aligned with the guide rail 31 and an upper position where a casette can be taken out of the bath.

In operation, the supply guide 34 is first moved to its upper position and the guide 35, for removing the plate, to its lower position. A casette 30 which holds a new plate to be treated is engaged in the guide 34 (manually or automatically) and the guide is lowered to its lower position. The casette 30 is then pushed toward the guide rail 31 to transfer it from the guide 34 to the guide rail 31. At the same time, a casette carrying the treated plate is pushed out of the guide rail at the other end and is engaged in the guide 35. The latter is raised to its upper position where the casette is removed from the bath. This step is repeated for continuous treatment.

Next, the efficiency of operation can be increased by circulating the flow of casettes in a manner as described below.

As shown in FIGS. 8 and 9, another guide rail 36 for circulating the casettes is provided in parallel with the guide rail 31 and at the same level as the upper positions for the guide members 34 and 35 with its ends aligned with the outer ends of the guides 34 and 35. At the outer side of the guide 34 and at the corresponding side of the guide rail 36, a pair of guides 37 and 37' are provided respectively. Similarly, at the outer side of the guide 35 and at the other side of the guide rail 36, a pair of guides 38 and 38' are provided respectively (FIG. 9). The positions of each pair of guides 37 and 37' (38 and 38') are interchangeable with each other.

In operation, the guide 35 in its lower position receives a casette 30 with the treated plate. It is moved to its upper position (shown in a dotted line in FIG. 10) where the treated plate A is removed and the vacant casette 30 is pushed onto the guide 38. The latter replaces the vacant guide 38' at one end of the guide rail 36.

When the casette 30 is pushed toward the guide rail 36, one casette will be pushed out from the other end of the guide rail 36 and be inserted into the guide 37'. Now, a new workpiece A is mounted on the casette (FIG. 10) and the guide 37' is moved to a position next to the guide 34 wherely the vacant guide 37 is moved to the side of the guide rail 36. After receiving the loaded casette from the guide 37', the guide 34 is lowered to the same level as the guide rail 31 to transfer the loaded casette to the rail 31. This step is repeated to circulate a plurality of casettes 30.

The anode plate 21 may be fixed like the cathode plate 22. But, preferably, an expendable electrode should be used because of the generation of gas during etching. An expendable electrode requires replacement at given time intervals. If it were a single elongated plate, the entire system would have to be stopped every time it is replaced and this would result in decreased productivity.

In order to solve this problem, the arrangement described below and illustrated in FIGS. 8, 9, 11 and 12 may be used.

A guide rail 40 is arranged parallel to the guide rail 31, the rail 40 carrying a plurality of casettes 50 on each of which a part of an anode plate 21 is mounted. These casettes are movable on the guide rail 40 so that a worn anode plate can be replaced with a fresh one without stopping the process.

The casette 50 comprises an insulating frame 51 having an opening 52 therein, and a frame 53 supporting the insulating frame 51. The frame 53 has a pair of rollers 54 at the top which engage the guide rail 40 for movement along the rail. An anode plate 21 is removably mounted in the opening 52. A wire 55 which is connected to the anode plate 21 has its other end connected to a feeder shoe 56, the feeder shoe being secured to the top of the frame 53. The feeder shoe sweeps along a bus bar 57 provided along the rail 40 to supply an electric current to the anode plate 21.

At each end of the guide rail 40 is provided a guide 41 (42) for vertical movement between a lower position aligned with the rail 40 and an upper position aligned with an upper rail 43 provided over the rail 40.

In operation, an anode casette 50 holding a new anode plate 21 is set on the guide 41 (FIG. 12), which is lowered to the same level as the guide rail 40. When the anode casette 50 is pushed toward the rail 40, a casette having a worn anode plate is ejected from the other end of the rail 40 to engage the guide 42. The latter is lifted to its upper position where the worn plate is removed. The casette 50, now vacant, is loaded with a new anode plate. The above-mentioned steps are repeated according to the rate at which the anode plates wear.

It will be understood that the above-described processes are suitable for continuous treatment of aluminum plates since it is not necessary to provide contacts on the workpieces and the frame 23 serves both as an insulating frame and as a support or holder for the workpieces.

In all of these processes however, the workpieces are supported substantially vertically on the insulating frame. This poses a problem in that each insulating frame requires several holders to prevent the workpiece from coming or dropping off. Additionally, automatic setting and removal of the workpieces on and from the insulating frames requires a considerably complicated mechanism. Circulation of a plurality of casettes carrying the insulating frames by means of guide rails also requires a relatively complicated mechanism.

Figure 14:
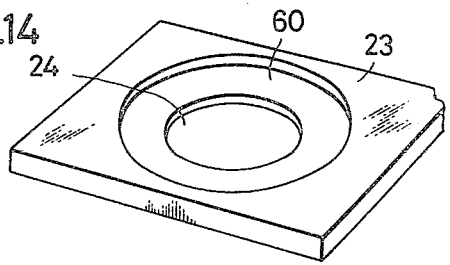
FIG. 14 is a perspective view of the insulating frame used therein.
Figure 13:
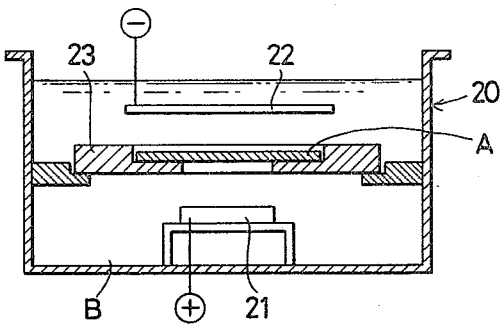
FIG. 13 is a vertical sectional side view of the second embodiment of this invention.

This problem can be solved by arranging the electrode plates and the insulating frame horizontally as shown in FIG. 13. In this arrangement, the cathode plate 22, insulating frame 23, and anode plate 21 are arranged vertically one over another. The insulating frame 23 has a recess 60 and an opening 24 in the recess (FIG. 14) with the workpiece held in the recess 60.

The workpiece A to be treated may be in the form of a flat plate, a dish or any desired configuration. The recess 60 is preferably of a shape similar to that of the workpiece, but is not limited to such a shape. The insulating frame 23 may have a plurality of openings, instead of one, or may have a multiplicity of small holes. It may also be adapted to carry a plurality of the workpieces by providing as many recesses and openings as there are workpieces to be treated. It may be of any desired shape around its periphery.

The insulating frame 23 does not necessarily have to be supported exactly horizontally, but may be inclined to such an extent as not to allow the workpiece to slip out of the frame.

Figure 15:
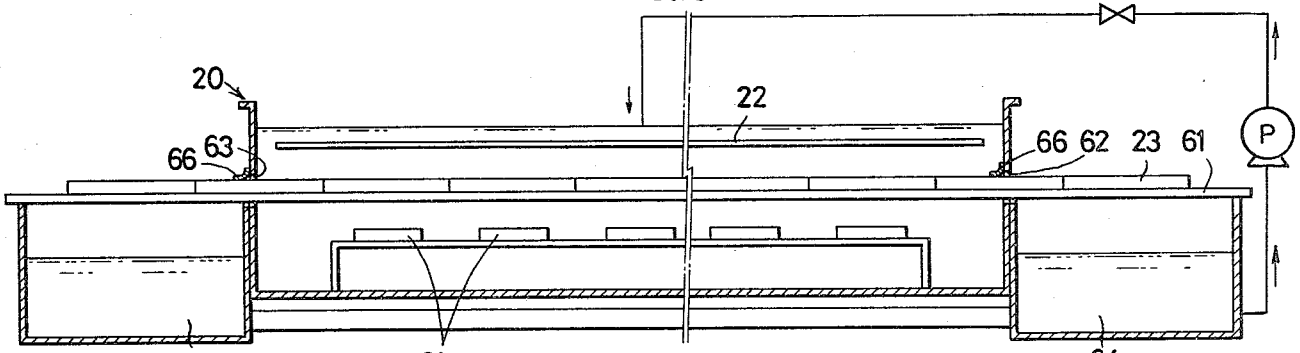
FIG. 15 is a vertical sectional front view thereof.
Figure 16:
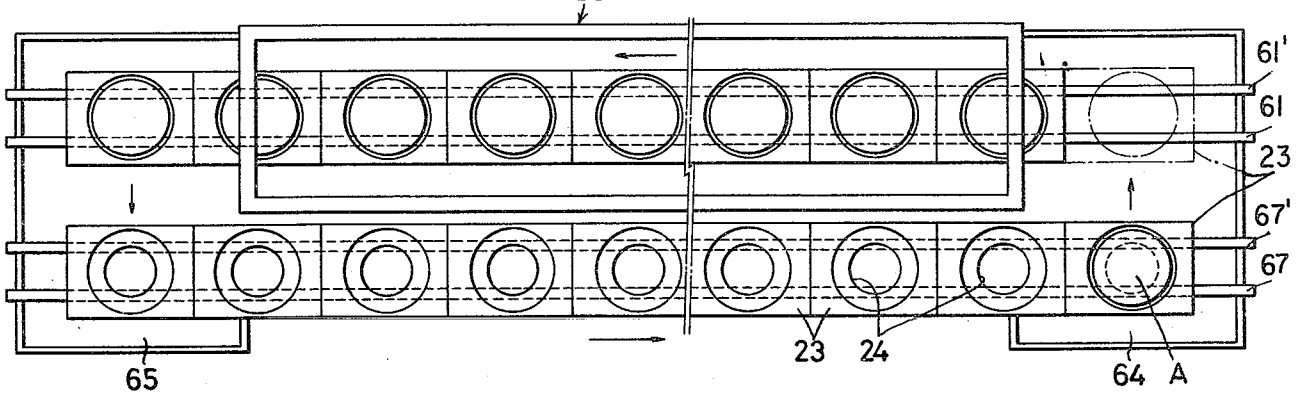
FIG. 16 is a plan view of the embodiment of FIG. 13 with another pair of guide rails attached.

FIGS. 15 and 16 show an embodiment using the above-described concept, in which a cathode plate 22 is arranged over a plurality of anode plates 21 in an electrolytic bath 20 having a suitable length. A pair of guide rails 61; 61' extend longitudinally between the anode plates 21 and the cathode plate 22 to support a plurality of insulating frames 23 which abut each other.

The pair of rails 61 and 61' may be spaced from each other at a suitable distance to support the insulating frames 23 either on their edges as in FIG. 13 or considerably inside the edges as in FIG. 16. The insulating frames 23 may be provided with grooves or projections to insure engagement with the rails 61 and 61'. Rollers may be provided on each insulating frame or on the rails 61 and 61' for smooth advancement.

The rails 61 and 61' extend beyond the ends of the electrolytic bath 20. The insulating frames 23 enter the bath 20 through an inlet 62 on the rails and leave it through an outlet 63. A plurality of workpieces can be continuously treated by putting them on the insulating frames on the guide rails and feeding them one after another into the bath.

At each end of the bath are provided tanks 64 and 65 for receiving the electrolyte leaking through the inlet 62 and the outlet 63, respectively. The electrolyte is pumped back from the tanks in to the bath 20. A rubber flap 66 may be provided at the inlet and outlet to minimize leakage.

It will be apparent that automatic circulation of the insulating frames 23 will increase the efficiency of the continuous treatment process. Such an embodiment is described below.

As shown in FIG. 16, a pair of rails 67 and 67' are provided outside the bath 20 and parallel to the rails 61 and 61' to support a plurality of empty insulating frames 23 which are lined up thereon. In operation, the workpiece A to be treated is placed on the insulating frame 23 on the rails 61 and 61' at the extreme right of the rails and the frame is pushed toward the bath 20. The row of insulating frames moves in the leftward direction so that one frame will be pushed out of the bath from the other end thereof. The treated workpiece is removed from the frame and the emptied frame is put on the rails 67 and 67' and pushed back toward the bath 20. This causes the empty frames on the rails 67 and 67' to advance in the rightward direction by an increment of one insulating frame sized space. This is repeated to thereby circulate the insulating frames.

Figure 17:
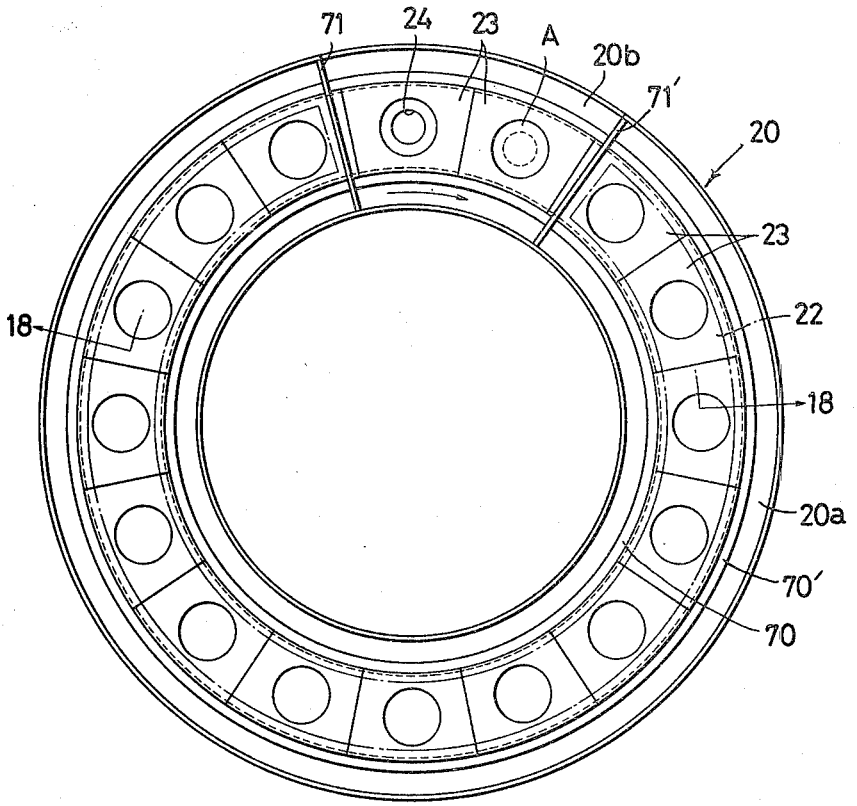
FIG. 17 is a plan view of the third embodiment of this invention.
Figure 18:
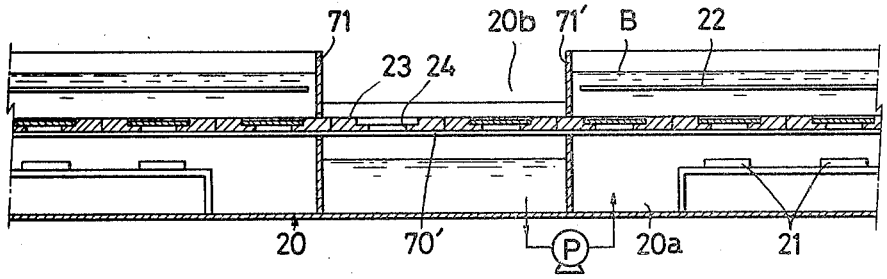
FIG. 18 is a sectional developed view taken along the line 18—18 of FIG. 17.

FIGS. 17 and 18 show another embodiment which enables the setting and removal of the works to be performed at the same position. In a circular bath 20 is provided a pair of ring guide rails 70 and 70' which extend around the bath, a plurality of fan-shaped insulating frames 23 are supported thereon and abut to one another.

A tank bath 20 is partitioned by partitions 71 and 71' into a bath **20*a* containing an electrolyte and a work space 20*b* where the workpieces A are set on and removed from the insulating frames. The space 20*b* also serves as an overflow tank for collecting the electrolyte that leaks out through the openings in partitions 71 and 71'. The collected liquid is pumped back into the bath 20*a*. The work space 20*b* may be adapted to contain either only two frames as shown or more. In this embodiment, the anode plates 21 and the cathode plate 22 are arranged vertically below and above the guide rails 70 and 70', respectively. A plurality of insulating frames 23 which are supported on the guide rails 70 and 70' are fed intermittently at a predetermined speed. As they pass through the electrolytic bath 20*a***, only the upper surface of the workpieces mounted thereon are electrolytically etched.

The frames 23, carrying the etched workpieces A, are fed out one after another through the wall 71 into the work space **20*b* where the etched workpiece is removed and a new work is set on the frame. The insulating frames 23 may be moved either by means of a rod engaged in the opening 24** in an empty frame and driven by a suitable drive means, or by driving one of the pair of guide rails. Also, an integral frame assembly consisting of a plurality of frame sections may be used instead of separate frames.

While various preferred embodiments have been described, it will be understood that many changes and variations can be made without departing from the scope of this invention.

What is claimed:

1. A process for uniform electrolytic etching of aluminum or an aluminum alloy, which comprises:

submersing a workpiece made of aluminum or aluminum alloy in an electrolyte which is contained in a tank, said workpiece being located between an anode and a spaced opposed cathode;

supporting said workpiece on an insulating frame so that said workpiece is parallel to said anode and cathode, said insulating frame having at least one opening therein and said insulating frame being larger than said workpiece, said opening in said insulating frame being smaller than said workpiece so that said workpiece is supported on one side by said insulating frame, around the peripheral regions of said workpiece so that the peripheral regions of said workpiece are covered by said insulating frame, the other side of said workpiece being urged towards said insulating frame and supported by holders and projections mounted on said insulating frame, said workpiece being supported with the side of said workpiece to be etched facing said cathode; and passing an electric current between said anode and cathode whereby said current energized said workpiece in a manner such that the side of said workpiece facing said cathode is uniformly etched.

2. A process as claimed in claim 1, wherein of the step supporting said workpieces further includes supporting each of a plurality of workpieces on one of a plurality of insulating frames, and continuously passing each of said workpieces supported on said insulating frames, between said anode and cathode, one after the other and, positioning said anode and cathode in spaced opposed relationship, one above the other in a vertical direction in said electrolyte, said anode being in the upper position and wherein said insulating frame has a recess for holding said workpiece therein, said insulating frame being supported in parallel to and between said anode and cathode by supporting members immersed in said electrolyte, and containing said electrolyte in a circular tank thereby forming a circular electrolytic bath.

3. A process as claimed in claim 1, further comprising positioning said anode and cathode in spaced opposed relationship, one above the other in a vertical direction in said electrolyte wherein said anode is in the upper position, and wherein said insulating frame has a recess for holding said workpiece therein, said insulating frame and workpiece being supported in parallel to and between said anode and cathode by supporting members immersed in said electrolyte, and further containing said electrolyte in a circular tank thereby forming a circular electrolytic bath.

4. A process as claimed in claim 1, wherein the step of supporting said workpieces further includes removably supporting a plurality of workpieces on a plurality of insulating frames, and continuously passing said workpieces supported on said insulating frames between said anode and cathode, one after the other, and positioning said anode and cathode in spaced opposed relationship, one above the other in a vertical direction said electrolyte, said anode being positioned in the upper portion and wherein said insulating frame has a recess for holding said workpiece therein, said insulating frame being supported parallel to and between said anode and cathode by supporting members which are located immersed in said electrolyte.

5. A process as claimed in claim 1, wherein the step of supporting said workpiece further includes supporting a plurality of workpieces, each removably supported on a plurality of insulating frames, and continuously passing each of said workpieces supported on said frames between said anode and cathode, one after the other.

6. A process as claimed in claim 1, further comprising positioning said anode and cathode in spaced opposed relationship, one above the other, in a vertical direction and immersed in said electrolyte, said anode being in the upper position.

7. A process as claimed in claim 2 further comprising positioning said anode and cathode in spaced opposed relationship, one above the other, in a vertical direction in said electrolyte, said anode being in the upper position.

8. A process as claimed in claim 2, further comprising positioning said anode and cathode in spaced opposed relationship, one above the other in a vertical direction in said electrolyte, wherein said anode is located in the upper position and containing said electrolyte in a circular tank thereby forming a circular electrolytic bath.

9. A process as claimed in claim 3 wherein said insulating frame has a recessed portion for holding said workpiece therein, said insulating frame being supported in parallel relation to and between said vertically spaced opposed anode and cathode by supporting members which are immersed in said electrolyte.

10. A process as claimed in claim 3, further comprising containing said electrolyte in a circular tank thereby forming a circular electrolytic bath.

* * * * *